US007298993B2

(12) United States Patent
Lee et al.

(10) Patent No.: US 7,298,993 B2
(45) Date of Patent: Nov. 20, 2007

(54) IMAGING METHODS, IMAGE ENGINES, AND PHOTOCONDUCTOR CHARGING SYSTEMS

(75) Inventors: Michael H. Lee, San Jose, CA (US); Boaz Tagansky, Rishon-Lezion (IL); Omer Gila, Cupertino, CA (US); William D. Holland, Palo Alto, CA (US); Seongsik Chang, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 190 days.

(21) Appl. No.: 11/030,475

(22) Filed: Jan. 5, 2005

(65) Prior Publication Data

US 2006/0147227 A1 Jul. 6, 2006

(51) Int. Cl.
*G03G 15/02* (2006.01)

(52) U.S. Cl. ..... 399/176; 399/168; 399/174

(58) Field of Classification Search ..... 399/168, 399/174–176

See application file for complete search history.

(56) References Cited

U.S. PATENT DOCUMENTS 5,943,533 A * 8/1999 Ogata et al. ..... 399/168
6,721,523 B2 * 4/2004 Sugiura et al. ..... 399/176
6,751,427 B2 6/2004 Sugiara
2003/0228172 A1 * 12/2003 Nakamura et al. ..... 399/176
2005/0008396 A1 * 1/2005 Nakamura et al. ..... 399/175
2005/0135839 A1 * 6/2005 Inoue ..... 399/175

FOREIGN PATENT DOCUMENTS

JP 06222649 A * 8/1994

* cited by examiner

*Primary Examiner*—Andrew H. Hirshfeld
*Assistant Examiner*—Timothy J Dole

(57) ABSTRACT

Imaging methods, image engines, and photoconductor charging systems are described. According to one embodiment, an imaging method includes providing a charge device configured to provide an electrical charge to a surface of an imaging member which is usable for imaging, moving a surface of the charge device adjacent to the imaging member and a bias member, during the moving, first charging a discharged portion of the surface of the charge device using the bias member providing a charged portion of the surface of the charge device, during the moving, second charging a portion of the surface of the imaging member using the charged portion of the charge device, the second charging providing the discharged portion of the surface of the charge device, and repeating the first charging and the second charging during the moving.

62 Claims, 8 Drawing Sheets

16
22
42
49
43
LIGHT SOURCE
44
24
20
40
41
46
26
54
28
48
50
52
30
56

IMAGING METHODS, IMAGE ENGINES, AND PHOTOCONDUCTOR CHARGING SYSTEMS

FIELD OF THE DISCLOSURE

Aspects of the disclosure relate to imaging methods, image engines, and photoconductor charging systems.

BACKGROUND OF THE DISCLOSURE

A multi-step electrophotographic (EP) process is the basis for numerous laser printers, copiers, multiple function devices, and other configurations. In a first step, a photoconductor is electrically charged for the subsequent formation of latent images. The photoconductor may be charged using one or more charge roller, corona or scorotron in some implementations. In but one example, the Indigo 3000 press available from The Hewlett-Packard Company has three sets of double scorotrons for charging the photoconductor.

A charge roller may include a metal shaft with a conductive elastomer surrounding it. The outer portion has been constructed in two ways in some arrangements. A first example includes a single layer with a moderately conductive material, usually an ionic conductive agent, mixed inside. A single-layer charge roller may also have a thin (e.g., thickness of a few microns) insulating layer outwardly of the conductive material or layer.

Another example of a charge roller has plural layers including an insulating outer sleeve of increased thickness (e.g., greater than a few microns) and an inner elastomeric region which may be loaded with a highly conductive network such as carbon. A double-layer charge roller generally charges less uniformly compared with a single layer charge roller due to the difficulty in providing a constant sleeve thickness. Accordingly, a single-layer charge roller system may provide images of increased quality and may be preferred for high-quality color image applications.

A core of a charge roller may be supplied with direct current (DC) electrical energy and possibly an additional alternating current (AC) voltage during use. If DC energy is used alone, the shaft voltage may be roughly 600 V higher than a desired voltage to be provided at a surface of the photoconductor. The extra 600 V is provided to generate ions in the air as dictated by the Paschen curve. With usage of AC energy, the voltage of the DC energy may be close to a desired photoconductor voltage with an AC amplitude of 600 V peak or more. The addition of AC usually creates a more uniform charge layer on the photoconductor adding or subtracting the photoconductor surface charge as needed.

The conduction mechanism of a single-layer charge roller is mobile ion movement in response to an applied electric field. If material (e.g., elastomer) is sandwiched between the two electrodes (e.g., charge roller shaft and photoconductor) and a voltage is applied, a current flows, generally falling with time. This is consistent with ions moving and accumulating at one side and leaving behind a charged layer of the opposite polarity on the other side which decreases the electric field available for moving current within the layer. Some charge injection may also occur at the electrodes which could neutralize some of the ions, thus decreasing the ion concentration over time.

For printers of relatively reduced speed, the charge roller may be engineered to last the life of a replaceable cartridge. For relatively high-speed machines, the charge roller may be expected to have extended use before needing replacement.

Over time, a charge voltage of a photoconductor may fall or drop. For example, referring to FIG. 1, measurements indicate that photoconductor charge voltage may drop over time with partial recovery during stoppage of imaging operations. In some situations, recovery may not occur even after imaging operations have ceased (e.g., no recovery is evident after a hour break at approximately 80,000 photoconductor page cycles (impressions) of FIG. 2).

The non-recovery of FIG. 2 may probably be attributed to two factors. First, a charge roller surface having a charge may attract charges of the opposite sign during operation. This can be partially remedied by turning off the charge roller since the charges may turn back towards the conductive shaft. In addition, some ions may leach from the surface due to relatively high concentrations and proximity to the surface and are lost due to recombination, decreasing the roller ion concentration. The long-term reduction in the photoconductor charge voltage is likely due to the latter. Accordingly, DC bias may be increased to provide a substantially constant photoconductor charge voltage.

The above-described situation may worsen if high-speed printing is implemented in non-stop applications because the charge roller may not be allowed to sufficiently recover. In this case, additional problems may be present. For example, the charge roller may physically degrade due to high ionic concentration at an interface for most desired charge roller formulations. The high concentration may alter a local environment within the charge roller causing polymeric bonds of the charge roller to break. The result is that the elastomeric portions of the charge roller may return to a liquid state in the local region. The environment may be catalytic because the deterioration has been observed to continue long after the voltage is removed and the charge roller may continue to disintegrate. Affected regions of the charge roller may have a surface defect or a sticky surface stain which may negatively impact electrophotographic processes.

Rollers of similar composition used to donate charge or bias a surface may suffer the same drawbacks (e.g., if run at high speed in non-stop applications). An example is a transfer roller used in some electrophotographic applications which helps move toner from the photoconductor to the printing media wherein a voltage is applied between the transfer roller and the photoconductor to attract toner from the imaged photoconductor.

At least some aspects of the disclosure include methods and apparatus for providing improved generation of hard images upon media.

SUMMARY

According to some aspects, imaging methods, image engines, and photoconductor charging systems are described.

According to one embodiment, an imaging method comprises providing a charge device configured to provide an electrical charge to a surface of an imaging member which is usable for imaging, moving a surface of the charge device adjacent to the imaging member and a bias member, during the moving, first charging a discharged portion of the surface of the charge device using the bias member providing a charged portion of the surface of the charge device, during the moving, second charging a portion of the surface of the imaging member using the charged portion of the charge device, the second charging providing the discharged portion of the surface of the charge device;, and repeating the first charging and the second charging during the moving.

According to another embodiment, an image engine comprises an imaging member configured to receive an electrical charge during imaging operations of the image engine, a discharge device configured to discharge selected portions of the imaging member to form latent images during the imaging operations of the image engine, a charge device positioned adjacent to the imaging member and having a surface comprising a plurality of portions, a bias member positioned adjacent to the charge device, and wherein individual ones of the surface portions of the charge device are rotated adjacent to the bias member to receive an electrical charge from the bias member and are rotated adjacent to the imaging member to impart the electrical charge to the imaging member during the imaging operations of the image engine.

DESCRIPTION OF THE DRAWINGS

FIG. 10 is an illustrative representation of an image engine according to one embodiment.

DETAILED DESCRIPTION

Figure 1:
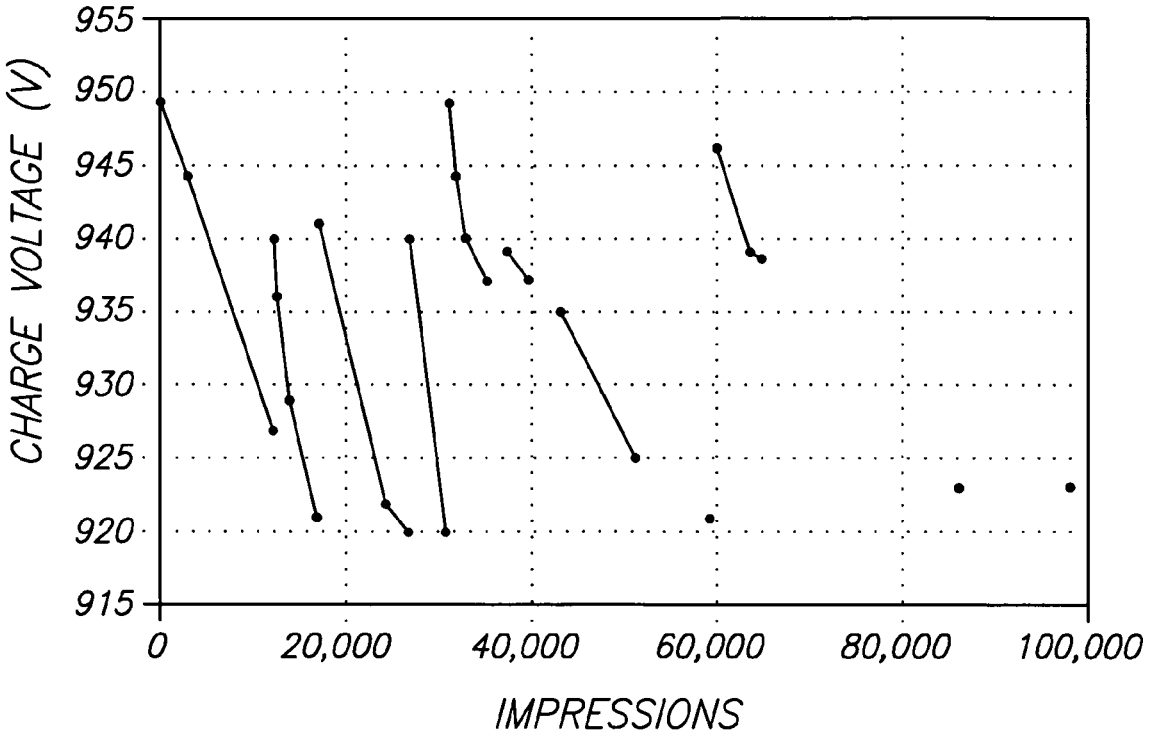
FIG. 1 is a graphical representation of charge voltage of a photoconductor with respect to number of impressions.
Figure 2:
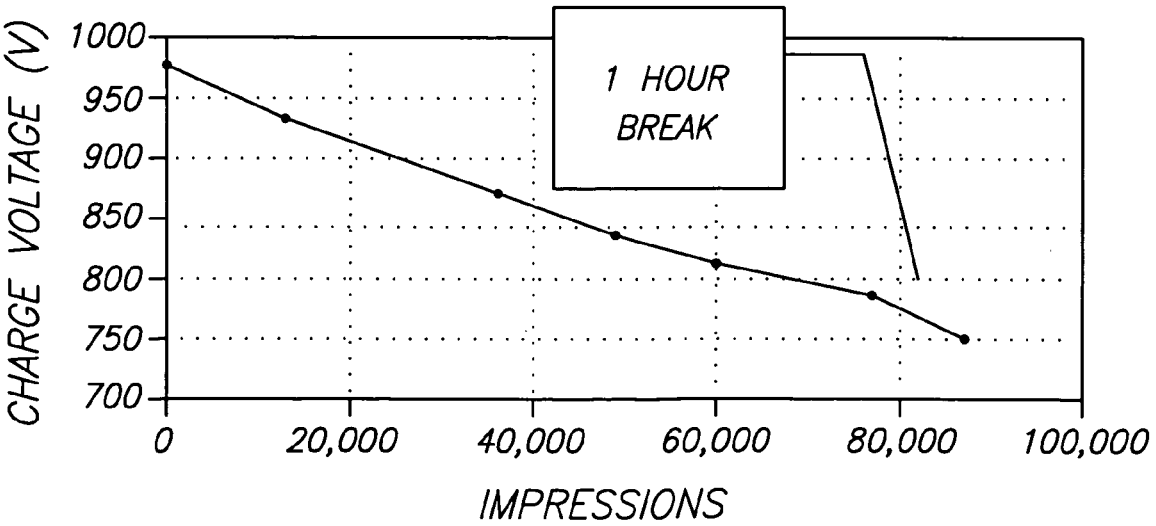
FIG. 2 is a graphical representation of charge voltage of a photoconductor with respect to number of impressions.
Figure 3:
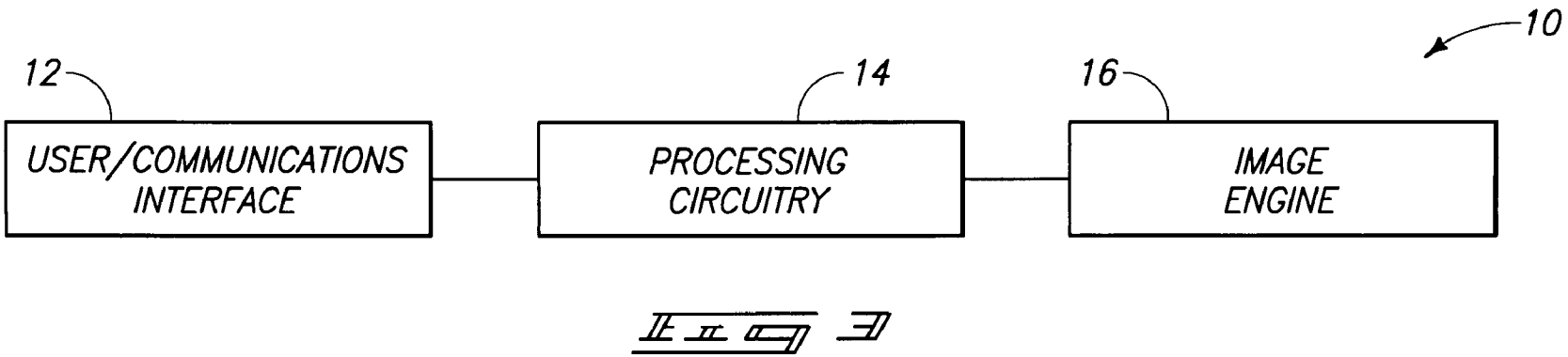
FIG. 3 is a functional block diagram of a hard imaging device according to one embodiment.

Referring initially to FIG. 3, an exemplary hard image device 10 is shown. Hard imaging device 10 is configured to form hard images upon output media, such as paper. In one embodiment, device 10 may be implemented as an electrophotographic press configured to print numerous hard images upon media at relative fast rates for extended periods of time (e.g., tens of thousands of sheets of media imaged per day). Other electrophotographic configurations or implementations of device 10 are possible including laser printers, copiers, facsimile devices, or other arrangements configured to form hard images upon media.

The depicted exemplary hard imaging device 10 includes a user/communications interface 12, processing circuitry 14, and an image engine 16. Additional components may be utilized to provide generation of hard images (e.g., media handling equipment, storage circuitry or memory configured to store image data, software, firmware, or other programming, etc.).

User/communications interface 12 is configured to interact with a user and/or implement external communications with respect to device 10. For example, interface 12 may include an input device such as a keyboard as well as a display (e.g., graphical user interface). Interface 12 may include an electrical interface such as a network interface card (NIC) in one embodiment to implement electrical data communications (input and/or output) externally of device 10.

Processing circuitry 14 is configured to process received user input, process image data, implement external communications, monitor imaging operations of device 10 and/or control imaging operations of device 10. Processing circuitry 14 may comprise circuitry configured to implement desired programming provided by appropriate media (e.g., hard disk, memory, etc.) in at least one embodiment. For example, the processing circuitry 14 may be implemented as one or more of a processor and/or other structure configured to execute executable instructions including, for example, software and/or firmware instructions, and/or hardware circuitry. Exemplary embodiments of processing circuitry 14 include hardware logic, PGA, FPGA, ASIC, state machines, and/or other structures alone or in combination with a processor. These examples of processing circuitry 14 are for illustration and other configurations are possible.

Image engine 16 is configured to form hard images upon media. For example, processing circuitry 14 may perform image processing operations upon data (e.g., rasterization) and provide the image data to image engine 16 for hard imaging upon media. An exemplary image engine 16 is configured to generate hard images upon media according to the received image data.

Figure 4:
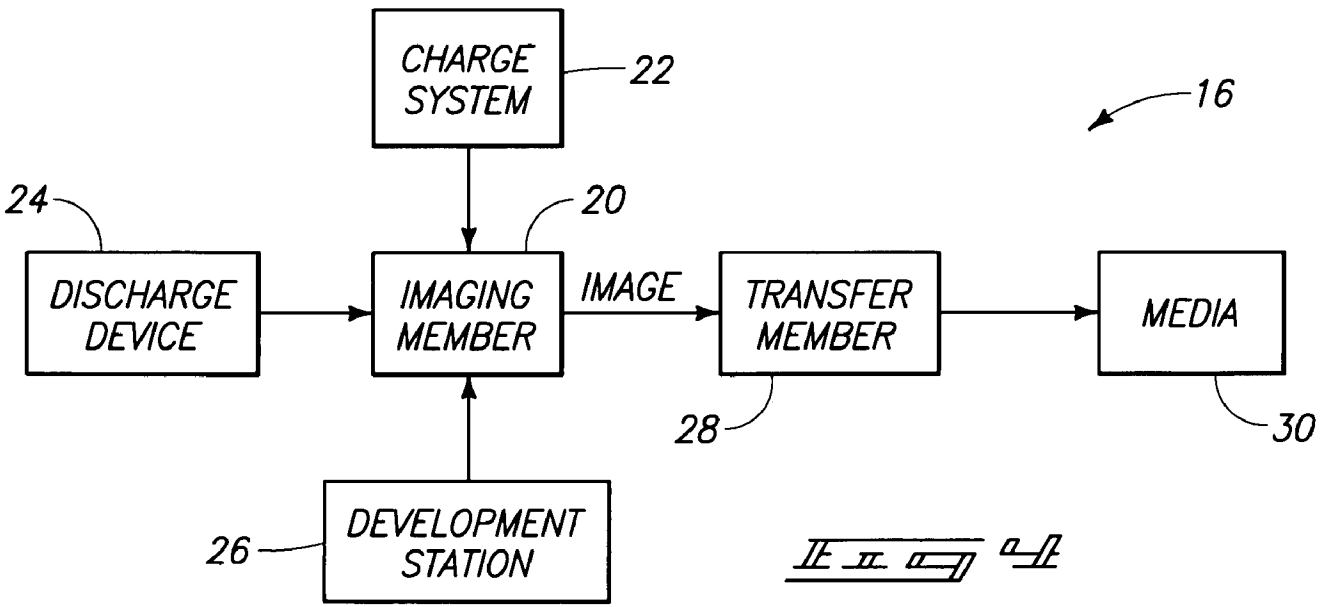
FIG. 4 is a functional block diagram of an image engine according to one embodiment.
Figure 5:
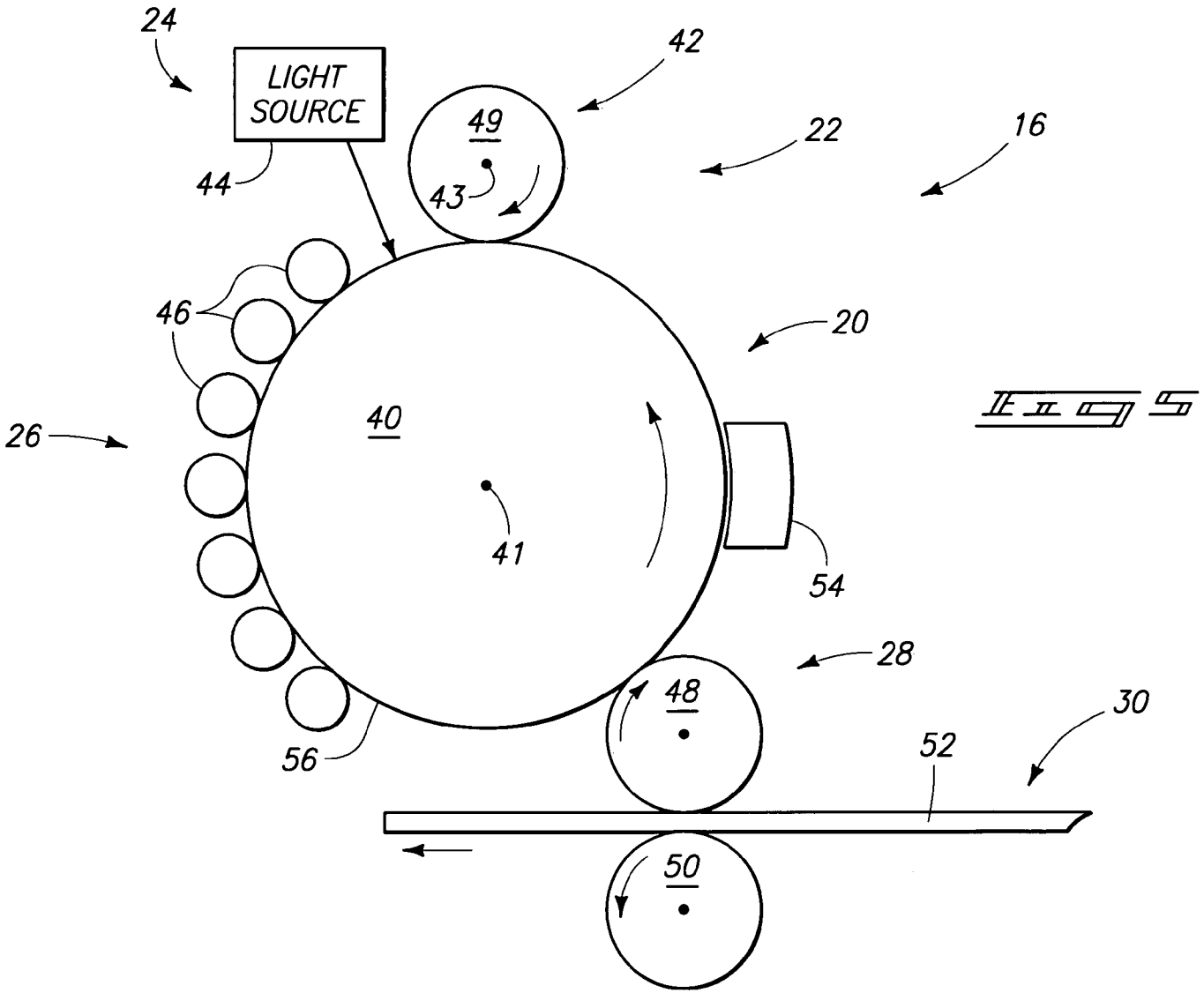
FIG. 5 is an illustrative representation of an image engine according to one embodiment.

Referring to FIGS. 4-5, details regarding an exemplary configuration of image engine 16 configured to implement electrophotographic imaging operations according to one embodiment are shown. The depicted image engine includes an imaging member 20, a charge system 22, a discharge device 24, a development station 26, a transfer member 28 and a cleaning station 54. Imaging member 20 is configured to receive an electrical charge from charge system 22 and may comprise a photoconductor, imaging media (e.g., paper) or other member configured to receive a charge for imaging. Other configurations of image engine 16 are possible including more, less or alternative components.

In one embodiment, imaging member 20 may comprise a photoconductor implemented as a photoconductor drum 40 (FIG. 5) in one example. An imaging region of member 20 may refer to portions of the outer surface wherein latent images are formed and developed as described further below. The imaging member 20 may rotate about an axis 41 in a counterclockwise direction in the exemplary described photoconductor drum embodiment wherein the outer surface passes adjacent to charge system 22, discharge device 24, development station 26 and transfer member 28. Other configurations of photoconductor (e.g., a photoconductor belt) are possible in other embodiments.

Charge system 22 includes a charge device 42 which is embodied as a charge roller 49 in the described exemplary embodiment shown in FIG. 5. Other embodiments of charge system 22 configured to provide an electrical charge are possible, for example, described with reference to FIGS. 6-8 and 10. Charge devices 42 apply an electrical charge to imaging members 20 such as a photoconductor, media or other components or structures for implementing imaging operations and which may be electrically charged. Charge device 42 embodied as a charge roller 49 is configured to provide an electrical charge (e.g., approximately negative 1000 V) to another imaging structure, such as the outer surface of imaging member 20 in one arrangement. The outer surface of imaging member 20 may be charged to other voltages and/or polarities in other embodiments. In one embodiment, charge roller 49 is configured to rotate about axis 43 and contact the imaging region of the outer surface of imaging member 20 to provide the electrical charge to the imaging region. Additional details regarding exemplary embodiments of charge systems 22 are shown and described with respect to FIGS. 6-8 and 10.

In the exemplary described embodiment, discharge device 24 is configured to discharge the electrical charge on the imaging member 20 at selected locations corresponding to a desired image to be formed. The discharging of the electrical charge provides a latent image upon the imaging region of the imaging member 20. In one embodiment, discharge device 24 may be implemented as a light source 44 (FIG. 5) such as a laser.

Development station 26 is configured to provide a marking agent, such as dry toner in a dry configuration or liquid ink in a liquid configuration. The marking agent may be electrically charged and attracted to the discharged locations of the imaging region of the imaging member 20 corresponding to the latent image to develop the latent image. Development station 26 may include a plurality of development rollers 46 (FIG. 5) which may provide marking agents of different colors to develop the latent images in one embodiment.

The marking agent of the developed image formed upon the imaging region of the imaging member 20 may be transferred to media 30 such as paper 52 using a transfer member 28. In one embodiment, transfer member 28 is configured as a transfer drum 48 (FIG. 5). An impression drum 50 may define a nip with transfer drum 48 to transfer the developed image to paper 52 in the embodiment of FIG. 5.

A cleaning station 54 shown in FIG. 5 may be provided to remove any marking agent which was not transferred from the imaging region to transfer drum 48 prior to recharging by charge roller 49. In one embodiment, cleaning station 54 may apply an imaging oil to the surface of imaging member 20 to assist with the removal of marking agent from the surface which was not transferred using transfer member 28.

At least some aspects of this disclosure are related to increasing the longevity of charge devices 42. Some aspects are discussed with respect to the exemplary embodiments of charge systems 22, 22*a*, 22*b*, 22*c* shown in FIGS. 6-10. Other configurations of charge systems 22 or charge devices 42 are possible.

Figure 6:
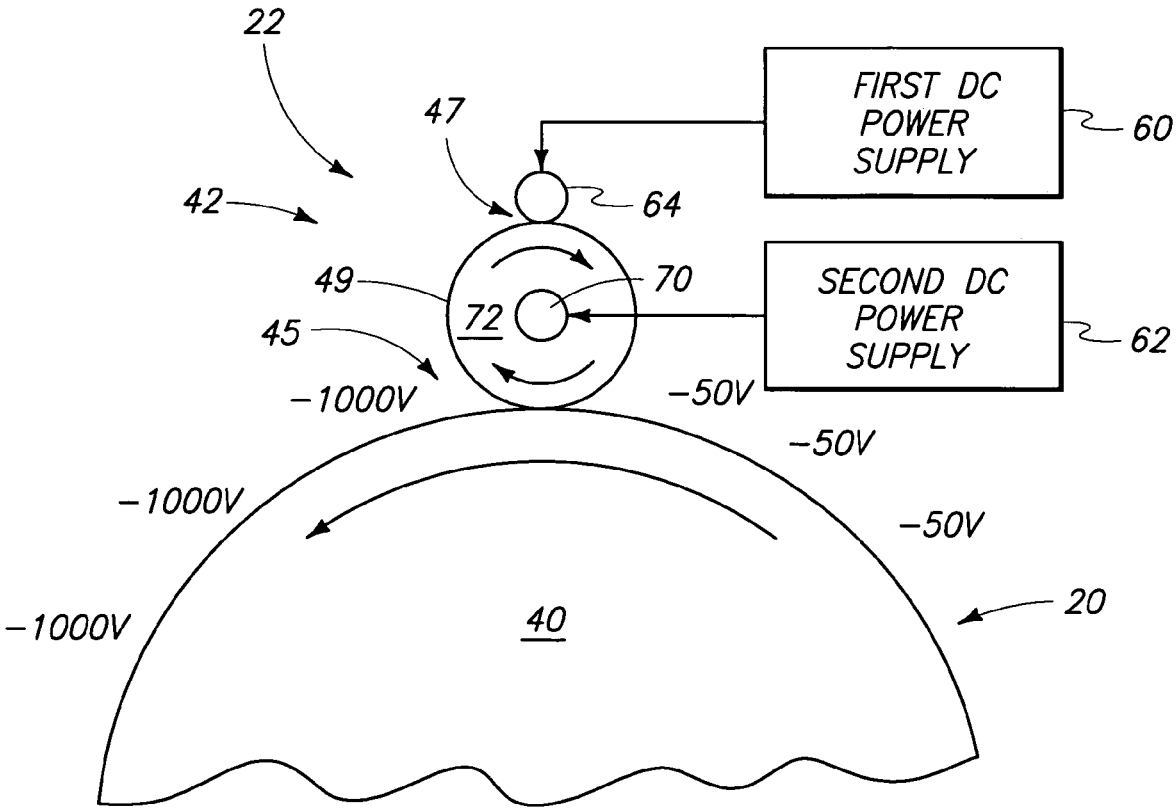
FIG. 6 is an illustrative representation of a charge system according to an embodiment.

Referring to FIG. 6, the illustrated exemplary charge system 22 includes charge device 42 embodied as charge roller 49, a first DC power supply 60, a second DC power supply 62 and a bias member 64. Charge device 42 is positioned to contact imaging member 20 at a nip location 45. Charge device 42 rotates with imaging member 20 embodied as a photoconductor drum 40 in the illustrated embodiment. In the illustrated embodiments, charge device 42 charges the outer surface of imaging member 20 from −50 V (i.e., discharged portions of the outer surface of imaging member 20) to −1000 V (i.e., charged portions of the outer surface). Charging may predominantly occur in a pre-nip region approximate 0.5 mm short of nip location 45 in at least one embodiment. In other embodiments, charge device 42 and imaging member 20 may be spaced at nip location 45 wherein charging of imaging member 20 occurs.

Bias member 64 may be implemented as a metal roller configured to contact charge device 42 at a nip location 47 in one embodiment. Bias member 64 may rotate with charge device 42 in one exemplary arrangement. Other current-carrying configurations of bias member 64 are possible including metal brushes or blades for example. In addition, bias member 64 may comprise carbon-loaded materials or other conductors other than metallic structures.

Portions of charge device 42 which have supplied charge carriers to charge imaging member 20 become discharged portions of charge device 42 after the charging. The discharged portions of charge device 42 are then rotated to contact bias member 64 whereby they are again charged for subsequent charging of the imaging member 20. At a given moment in time, bias member 64 charges the portion of the outer surface of charge device 42 approximate nip location 47. Accordingly, less than an entirety of an outer surface of charge device 42 is charged by the bias member 64 at a given moment in time. In other embodiments, bias member 64 and charge device 42 may be spaced at nip location 47 wherein charging of charge device 42 occurs.

Charge device 42 includes a core 70 and an outer layer 72 about core 70 in the exemplary illustrated arrangement. In one implementation, core 70 is a metal shaft and outer layer 72 may be embodied as a conductive elastomer layer which may be constructed as described above in possible single layer and double layer embodiments. Outer layer 72 is configured to store charge carriers in one embodiment. For example, the charge carriers may be donated by bias member 64 and passed to imaging member 20.

It is believed that DC current flow within outer layer 72 (e.g., between core 70 and outer layer 72) during imaging operations may lead to degradation of outer layer 72. Some results suggest that the process of disintegration may be initiated after a certain total net DC charge has passed through the material of the outer layer 72. According to one aspect of charge system 22, net DC current flow within layer 72 (e.g., into or out of core 70) is reduced, minimized or eliminated to reduce degradation of charge device 42.

Still referring to FIG. 6, DC power supply 60 is coupled with bias member 64 and DC power supply 62 is coupled with core 70 of charge device 42. As discussed further below, power supply 60 may apply a desired electrical bias to bias member 64 to reduce net DC current or charge flowing within layer 72. Power supply 62 may apply a desired electrical bias to core 70 to provide an appropriate charge to the outer surface of imaging member 20 as is also discussed further below.

In one embodiment, charge system 22 is arranged to provide a charge of approximately −1000 V upon the outer surface of imaging member 20 rotated adjacent to charge device 42. Second power supply 62 is configured to provide electrical energy having a sufficient voltage magnitude to overcome losses while providing the desired voltage upon the outer surface of imaging member 20. For example, power supply 62 may provide a voltage of approximately −1600 V to core 70 to provide the desired voltage to the outer surface (e.g., −1000 V).

As mentioned above, power supply 60 may charge bias member 64 to a proper voltage to reduce the net DC current or charge flowing in outer layer 72 during charging of imaging member 20. In the above-described example wherein the surface of imaging member 20 is charged to approximately −1000 V, power supply 60 may provide a bias voltage of approximately −1800 V to bias member 64. Accordingly, power supplies 60, 62 provide voltages of the same polarity to charge device 42 and bias member 64 in at least one embodiment.

It is believed that DC current passing through outer layer 72 (either into core 70 or from core 70) may be related to disintegration of charge device 42 and/or voltage drops of charge received by the outer surface of imaging member 20 during charging of imaging member 20. More specifically, the continuous passage of DC current in a single direction (e.g., either radially into or out of core 70) may lead to the negative operational aspects described above. Bias member 64 applies current to charge device 42 to provide current passing in different directions (e.g., different radial directions) through outer layer 72 during imaging operations to reduce DC current flow in a single direction through layer 72 (e.g., into or out of core 70) during imaging.

Consider a surface patch on the outer surface of charge device 42 and a region of outer layer 72 inward of the surface patch. When the patch contacts imaging member 20, charge carriers (e.g., depending upon the biasing polarities involved exemplary charge carriers include electrons, negatively charged ions, positively charged ions, etc.) from the patch and the underlying region are donated or transported in a substantially radial direction of charge device 42 to the discharged surface of imaging member 20 to charge the surface from −50 V to approximately −1000 V. After the charge device 42 rotates 180 degrees in the illustrative example, the patch contacts bias member 64 which donates charge carriers which are transported in a substantially radial direction of charge device 42 to the patch and underlying region for restoration to a rest state. The charging of charge device 42 may be imparted from an area and a direction external of the outer surface of the charge device 42 in at least one embodiment. As shown, different portions of charge device 42 may be simultaneously donating and receiving charge carriers during imaging operations.

Accordingly, in one embodiment, during charging of imaging member 20, charge carriers of one sign flow in one direction with respect to the outer surface of charge device 42 while charge carriers of the same sign flow in an opposite direction with respect to the outer surface of charge device 42 during charging of charge device 42 by bias member 64. It follows that the DC current flow relative to the outer surface of charge device 42 is substantially b-directional or AC in nature and the net DC current flow through material of outer layer 72 is substantially zero in the exemplary embodiments of FIGS. 6-8 during imaging operations leading to extended life of charge device 42.

According to the described example wherein the imaging member 20 is negatively charged, negative charge carriers flow from the charge device 42 to the imaging member 20 when the imaging member 20 is being charged and negative charge carriers flow from the bias member 64 to the charge device 42 when the charge device 42 is being charged. With respect to the outer surface of charge device 42, the directions of the above-described charge carrier flow are opposite for the charging of the imaging member 20 and the charge device 42.

Figure 7:
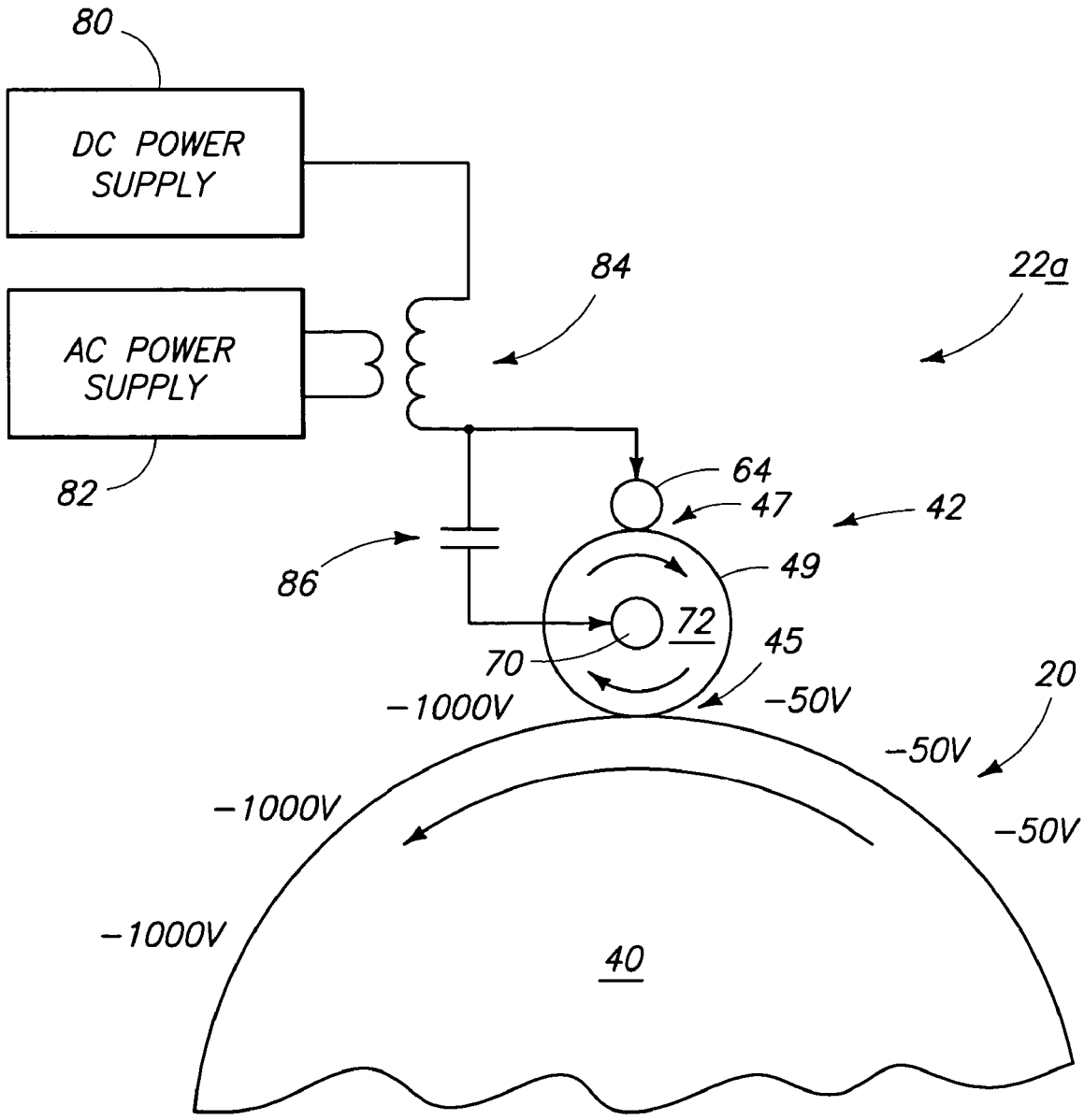
FIG. 7 is an illustrative representation of a charge system according to an embodiment.
Figure 8:
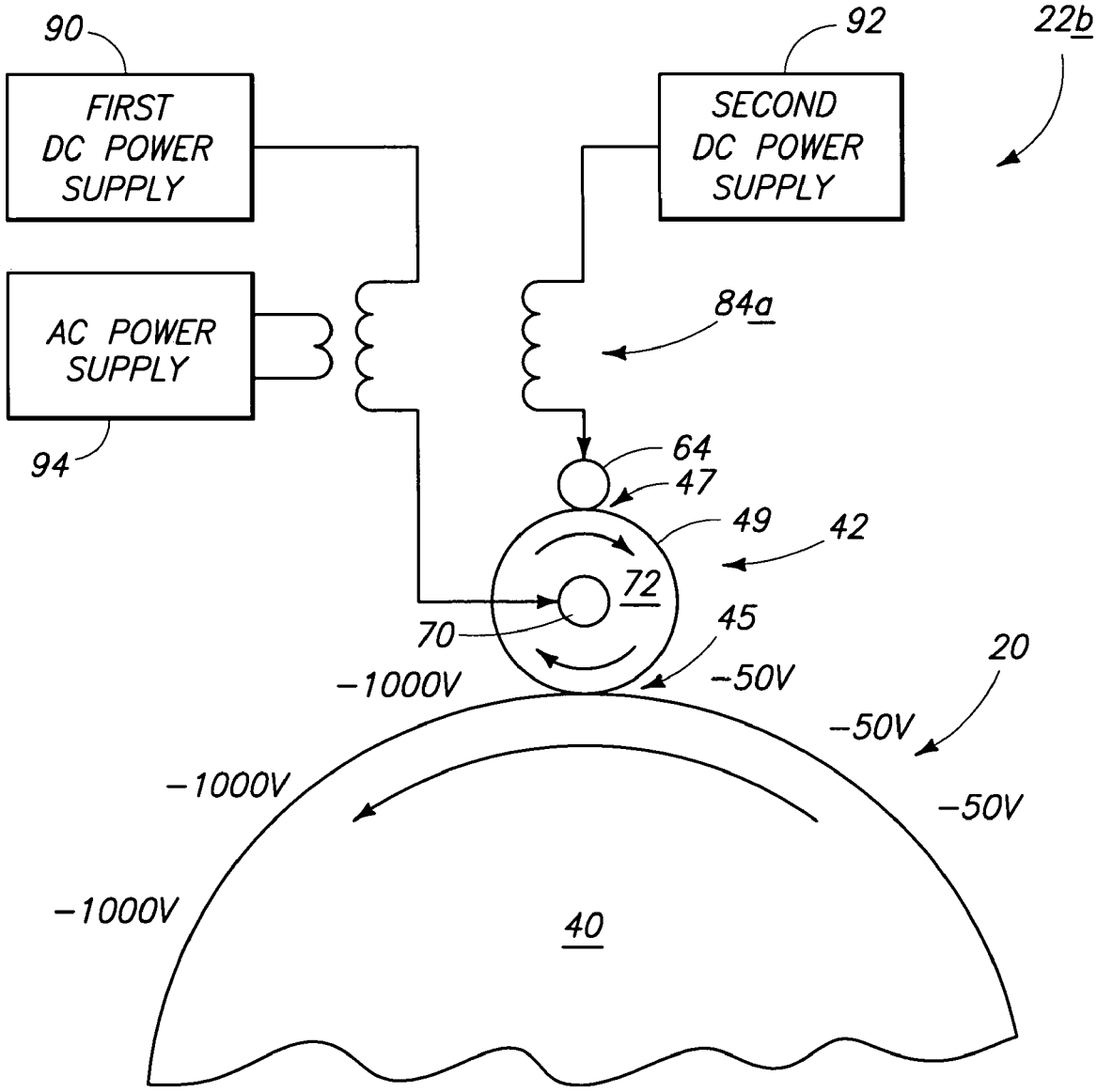
FIG. 8 is an illustrative representation of a charge system according to an embodiment.

Referring to the embodiments of FIGS. 7-8, exemplary charging systems 22*a*, 22*b* may utilize AC voltages to implement charging of imaging member 20. The utilization of AC voltages may result in more efficient charging by the respective systems 22*a*, 22*b* compared with the DC charging system 22. The AC voltages may more efficiently initiate Paschen breakdown in the air gaps adjacent to contact nip 45 between imaging member 20 and charge device 42.

Referring to FIG. 7, an exemplary charging system 22*a* which utilizes AC voltages is shown. The depicted charging system 22*a* includes a DC power supply 80, an AC power supply 82, a step-up transformer 84 and a coupling capacitor 86 in addition to the previously described illustrated components of charging system 22.

In embodiments wherein the imaging member 20 is charged to −1000 V, DC power supply 80 may provide a DC voltage of about −1300 V and AC power supply 82 may provide electrical energy of 1400 V peak-to-peak and having a frequency of 6 kHz in one implementation. Transformer 84 adds the AC voltage to the output of the DC power supply 80 to produce the drive voltage for bias member 64. Coupling capacitor 86 passes the AC voltage to core 70 of charge device 42. Application of the AC voltage to charge device 42 and bias member 64 induces Paschen breakdown in the air gaps adjacent to contact nip 45 of imaging member 20 and charge device 42 providing imaging member 20 with a more uniform voltage compared with the embodiment of FIG. 6. In addition, loading upon AC power supply 82 may be reduced if the charge device 42 and bias member 64 are maintained at substantially the same AC voltage.

A value of coupling capacitor 86 may be chosen so the AC reactance of the coupling capacitor 86 is relatively small compared to the AC reactance of the charge device 42. In one embodiment, a value of coupling capacitor 86 may be 0.01 uF or larger for an embodiment wherein a capacitance of the core 70 to imaging member 20 is approximately 600 pF.

Referring to FIG. 8, another possible embodiment of charging system 22*b* utilizing AC voltages is shown. With respect to the embodiment of FIG. 7, the depicted charging system 22*b* omits capacitor 86, and includes a transformer 84*a* having plural secondary windings, plural DC power supplies 90, 92 and an AC power supply 94.

As shown, first and second DC power supplies 90, 92 are coupled with first and second secondary windings of transformer 84*a*, respectively. First DC power supply 90 may provide a DC voltage of approximately −1200 V and second DC power supply 92 may provide a DC voltage of approximately −1300 V to charge the outer surface of imaging member 20 to −1000 V according to the exemplary disclosed embodiment. AC power supply 94 may provide an AC voltage of 600 V peak-to-peak at a frequency of 6 kHz in one embodiment.

As discussed above with respect to FIG. 6, the implementation of bias member 64 in the arrangement of FIGS. 7-8 provides DC current flow in the outer layer 72 in opposing directions. Accordingly, during imaging operations, the net DC current flow within outer layer 72 is reduced (e.g., substantially zero in the described embodiments) which has been observed to improve the longevity of charge device 42.

The embodiments described herein are applicable to Indigo digital presses available from The Hewlett-Packard Company. The voltage values of the above-described embodiments may be tailored for application to other digital press configurations. For example, the described charge systems 22, 22*a*, 22*b* may be used to charge a positive-charging imaging member 20 wherein positive charge carriers would be conducted reversing all of the above-described DC voltages (i.e., the charge carriers include electrons or negative ions in the above-described embodiments having a negative-charging imaging member 20). If negative charges are also involved, they move in a direction opposite to that of positive charges. The values of the generated DC voltages may also be adjusted to achieve other desired charged voltages of the imaging member 20. In addition, the frequency of the AC voltage may be tailored to a minimum value to reduce or avoid visible banding plus a small safety margin reducing the current and power provided by the AC supply to a minimum value. In general, lower frequencies may be used for hard imaging devices 10 having slower process speeds. In the above-described embodiments, AC voltage having a frequency of 6 kHz may be used for process speeds of hard imaging devices 10 of 1.2 meters/second.

Figure 9:
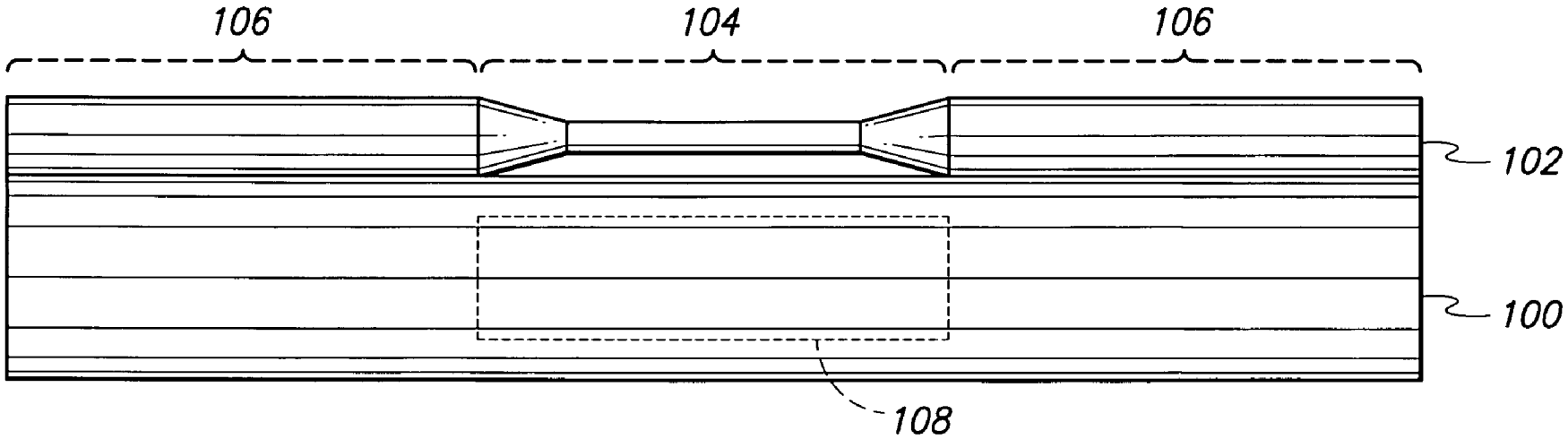
FIG. 9 is an illustrative representation of a charge roller and a modified bias roller for implementing testing of exemplary aspects according to one embodiment.
Figure 11:
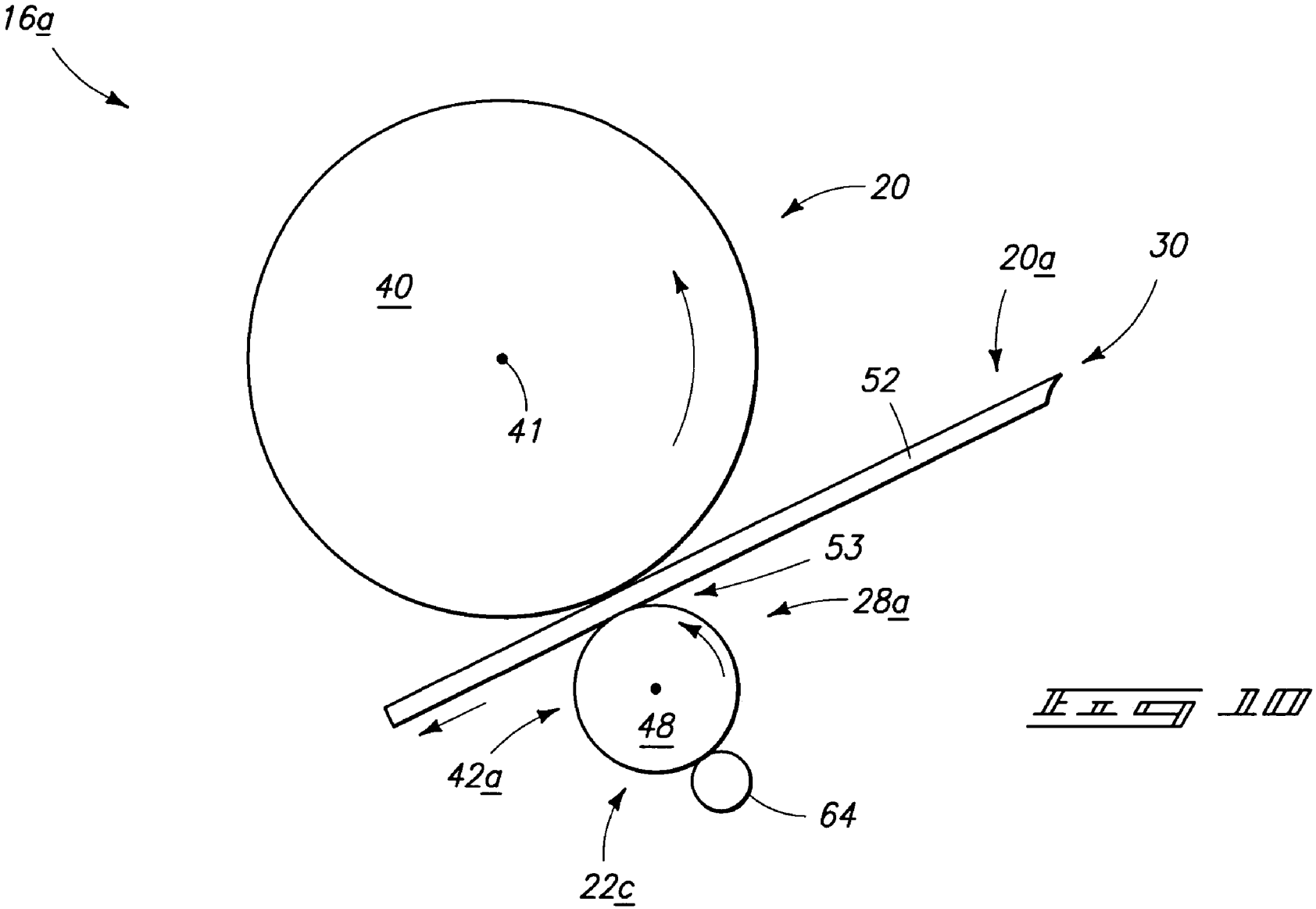

Referring to FIG. 9, a configuration of a charge roller 100 with a modified bias roller 102 was tested in an Indigo 2000 Press available from The Hewlett-Packard Company. In order to test both configurations with and without the bias roller 102 simultaneously, a section 104 of the bias roller 102 was tapered down to a smaller diameter within which the bias roller 102 is not in contact with the charge roller 100. Remaining sections 106 of bias roller 102 are in contact with the charge roller 100. The length of the section 104 is a third of the length of the charge roller 100 in the illustration.

AC voltage was not used during the tests illustrated using the arrangement of FIG. 9 while two DC power supplies were used, one for the bias roller 102 and one for the core of the charge roller 100 as described above with respect to FIG. 6 in one implementation. The voltage for the core of the charge roller 100 was adjusted to obtain the proper photoconductor charge voltage. The voltage for the bias roller 102 was adjusted so that the current drawn from the respective adjusted power supply of the bias roller 102 was twice as much as the current drawn from the power supply coupled with the charge roller 100. In this way, a middle section 108 of the charge roller 100 was solely driven by the charge roller power supply and outer sections solely by the bias roller 102. Assuming the outer sections of the charge roller 100 are driven solely by the bias roller 102, the net DC current flow within the outer sections of charge roller 100 was substantially zero throughout the charging experiment.

After a semi-continuous run of 200 K impressions (60 K impressions per day) middle section 108 of charge roller 100 started showing surface damage while the outer sections showed no surface damage. Some of the rubber material of the middle section 108 liquefied and portions of the outer layer became detached in these areas. Simple application of finger pressure produced wrinkles on the charge roller surface coating in the middle section 108 and the liquefied charge roller material leaked out through breaks in a coating. The outer sections of charge device 100 showed no visible damage or change compared with the beginning of the experiment.

Referring to FIG. 10, another example of an image engine 16*a* including another configuration of a charge system 22*c* is shown. The depicted exemplary image engine 16*a* omits illustration and discussion of other components discussed above which may be provided, such as charge systems 22, 22*a* or 22*b* to charge photoconductor drum 40, discharge device 24, development station 26 or other appropriate components to implement imaging operations.

The depicted image engine 16*a* includes transfer member 28*a* including a transfer drum 48. Charge system 22*c* is implemented using transfer drum 48 and bias member 64 in the depicted embodiment. Transfer drum 48 defines a nip 53 with photoconductor drum 40 in the illustrated embodiment. Media 30 is configured to pass through nip 53 to receive developed images from photoconductor drum 40. Transfer drum 48 and bias member 64 of charge system 22*c* may be coupled with respective power supplies (not shown). For example, transfer drum 48 may be referred to as a charge device 42*a* electrically biased to assist with the attraction of the developed image from the photoconductor drum 40. More specifically; charge device 42*a* implemented as transfer drum 48 may charge the imaging member 20*a* comprising media 30 in the depicted example to assist with the transfer of developed images. Outer surface portions of charge device 42*a* which charge media 30 may be discharged during imaging. Bias member 64 may rotate with charge device 42*a* and be used to charge discharged portions of the outer surface of charge device 42*a* to reduce degradation of charge device 42*a* as described above. The embodiments herein illustrate exemplary aspects of the disclosure and other configurations of charge systems, charge devices and bias members are possible.

The protection sought is not to be limited to the disclosed embodiments, which are given by way of example only, but instead is to be limited only by the scope of the appended claims.

What is claimed is:

1. An imaging method comprising:

providing a charge device configured to provide an electrical charge to a surface of an imaging member which is usable for imaging;

moving a surface of the charge device adjacent to the imaging member and a bias member;

during the moving, first charging a discharged portion of the surface of the charge device using the bias member providing a charged portion of the surface of the charge device; during the moving, second charging a portion of the surface of the imaging member using the charged portion of the charge device, the second charging providing the discharged portion of the surface of the charge device;

repeating the first charging and the second charging during the moving; and providing electrical energy independent of the bias member to the charge device to bias the charge device during the second charging.

2. The method of claim 1 wherein the providing the charge device comprises providing a charge roller, and the moving comprises rotating the surface of the charge roller adjacent to and in contact with the imaging member comprising a photoconductor.

3. The method of claim 1 wherein the providing the charge device comprises providing a transfer member configured to provide the electrical charge to the surface of the imaging member comprising media.

4. The method of claim 1 further comprising biasing the bias member at a substantially constant DC voltage, and the providing comprises providing the electrical energy having a substantially constant DC voltage.

5. The method of claim 1 wherein substantially zero net DC current flows with respect to the surface of the charge device during the first and second chargings.

6. The method of claim 1 further comprising providing electrical energy to the bias member having the same polarity as the electrical energy provided to the charging device.

7. The method of claim 1 further comprising providing an AC voltage to the bias member and the providing electrical energy comprises providing an AC voltage to the charge device.

8. The method of claim 1 wherein a plurality of charge carriers of one polarity move in a first direction relative to the surface of the charge device during the first charging and a plurality of charge carriers of the same polarity move in a second direction relative to the surface of the charge device during the second charging and substantially opposite to the first direction.

9. The method of claim 1 wherein the first charging comprises charging less than an entirety of the surface of the charge device.

10. The method of claim 1 further comprising applying an AC voltage to the bias member during the moving and the providing electrical energy comprises providing an AC voltage to the charge device.

11. The method of claim 1 further comprising applying a DC voltage to the bias member and the providing the electrical energy comprises applying a DC voltage to the charge device during the moving.

12. The method of claim 1 wherein the moving comprises moving the surface of the charge device through a plurality of complete revolutions, and wherein the providing electrical energy comprises providing the electrical energy having a constant voltage to the charge device during entireties of the moving the surface of the charge device through the complete revolutions.

13. The method of claim 1 wherein the moving comprises moving the surface of the charge device through a plurality of complete revolutions, and wherein the providing electrical energy comprises biasing the charge device using electrical energy having a first voltage; and biasing the bias member using electrical energy having a second voltage, and an absolute value of the second voltage is greater than an absolute value of the first voltage during entireties of the moving the surface of the charge device through the complete revolutions.

14. The method of claim 1 further comprising;

biasing the bias member using electrical energy during the first charging and the second charging, and wherein a voltage of the electrical energy used to bias the bias member has a larger absolute value than an absolute value of a voltage of the electrical energy provided to the charge device; and printing images during the biasing and the providing.

15. The method of claim 14 wherein the moving comprises moving the surface of the charge device through a plurality of complete revolutions, and wherein the voltage of the electrical energy provided to the charge device is constant during entireties of the moving the surface of the charge device through the complete revolutions.

16. The method of claim 1 further comprising; during the moving, forming a latent image using the portion of the surface of the imaging member; and during the moving, developing the latent image using a marking agent comprising a liquid ink.

17. The method of claim 1 wherein the first charging and the second charging individually comprise conducting current one of into and out of the surface of the charge device comprising an electrically conductive outer surface.

18. The method of claim 1 wherein the first charging and the second charging individually comprise conducting current external of the charge device and one of into and out of the surface of the charge device.

19. An imaging method comprising:

providing an imaging member having a surface;

providing a charge device configured to provide an electrical charge to the surface of the imaging member which is usable for imaging;

first transporting a plurality of charge carriers intermediate the imaging member and the charge device to charge a portion of the surface of the imaging member using the charge device;

second transporting a plurality of charge carriers to charge a portion of a surface of the charge device;

wherein the charge carriers of the first transporting travel in a first direction with respect to the surface of the charge device and the charge carriers of the second transporting travel in a second direction with respect to the surface of the charge device substantially opposite to the first direction; and applying electrical energy to the charge device during and independent of the first and second transportings.

20. The method of claim 19 wherein the charge carriers of the first and second transportings have the same polarity.

21. The method of claim 19 wherein the charge device comprises a charge roller, and further comprising rotating the surface of the charge device adjacent to a bias member, and wherein the second transporting comprises transporting the charge carriers intermediate the bias member and the charge device.

22. The method of claim 19 wherein the charge device comprises a charge roller and the first direction and the second direction comprise substantially opposite radial directions of the charge roller.

23. The method of claim 19 wherein the first transporting comprises donating charge carriers of one polarity from the charge device and the second transporting comprises donating charge carriers of the same polarity from a bias member.

24. The method of claim 19 wherein the second transporting comprises transporting the charge carriers intermediate the charge device and a bias member located externally of the charge device.

25. The method of claim 19 wherein the first transporting comprises transporting the charge carriers one of into and out of the surface of the charge device and the second transporting comprises transporting the charge carriers the other of into and out of the surface of the charge device.

26. The method of claim 19 wherein the second transporting comprises transporting the charge carriers to charge less than an entirety of the surface of the charge device at a given moment in time.

27. The method of claim 19 wherein the first and second transportings are simultaneous.

28. The method of claim 27 wherein the first transporting comprises first charging the portion of the Imaging member using another portion of the surface of the charge device at one moment in time, and the second transporting comprises second charging less than an entirety of the surface of the charge device including the portion during the one moment in time.

29. The method of claim 19 wherein substantially zero net DC current flows within an outer layer of the charge device during the first and second transportings.

30. The method of claim 19 wherein the first and second transportings individually comprise transporting respective ones of the charge carriers using the surface of the charge device comprising an electrically conductive outer surface.

31. An imaging method comprising:

providing an imaging member having a surface;

providing a charge device configured to provide an electrical charge to the surface of the imaging member which is usable for imaging;

first charging a portion of a surface of the charge device from a direction external of the surface of the charge device, the first charging providing a charged portion of the surface of the charge device;

after the first charging, second charging a portion of the surface of the imaging member using the charged portion of the surface of the charge device; and providing electrical energy independent of the first charging to the charge device to bias the charge device during the second charging.

32. The method of claim 31 wherein the first and second chargings comprise moving charge carriers of one polarity in substantially opposite directions with respect to the surface of the charge device.

33. The method of claim 31 wherein the first and second chargings comprise moving charge carriers between an area outside of the charge device and an outwardly exposed surface of the charge device.

34. The method of claim 31 wherein the providing the charge device comprises providing the charge device comprising an outer layer configured to store plural charge carriers received during the first charging.

35. The method of claim 34 wherein substantially zero net DC current flows within the outer layer during the first and second chargings.

36. The method of claim 31 wherein the first charging comprises charging the portion of the surface of the charge device which comprises an electrically conductive outer surface and wherein the second charging comprises charging using the charged portion of the electrically conductive outer surface.

37. An image engine comprising:

an imaging member configured to receive an electrical charge during imaging operations of the image engine;

a discharge device configured to discharge selected portions of the imaging member to form latent images during the imaging operations of the image engine;

a charge device positioned adjacent to the imaging member and having a surface comprising a plurality of portions;

a bias member positioned adjacent to, the charge device;

wherein individual ones of the surface portions of the charge device are rotated adjacent to the bias member to receive an electrical charge from the bias member and are rotated adjacent to the imaging member to impart the electrical charge to the imaging member during the imaging operations of the image engine; and circuitry configured to provide electrical energy independent of the bias member to the charge device to bias the charge device.

38. The engine of claim 37 wherein a plurality of charge carriers of one polarity are transported in a first direction relative to the surface of the charge device intermediate the charge device and the bias member and in a second direction relative to the surface of the charge device intermediate the charge device and the imaging member opposite to the first direction.

39. The engine of claim 38 wherein the charge device comprises a charge roller and the first and second directions comprise opposing radial directions of the charge roller.

40. The engine of claim 37 wherein substantially no net DC current flows within an outer layer of the charge device during the reception of the electrical charge by the charge device and the imparting of the electrical charge to the imaging member.

41. The engine of claim 37 wherein the charge device contacts the bias member and the imaging member during the reception of the electrical charge by the charge device and the imparting of the electrical charge to the imaging member.

42. The engine of claim 37 further comprising a development station configured to apply a liquid marking agent to a surface of the imaging member to develop the latent images.

43. The engine of claim 42 further comprising a transfer member configured to transfer the developed latent images to media.

44. The engine of claim 43 wherein the transfer member comprises another charge device.

45. The engine of claim 37 wherein an AC voltage is applied to the bias member and the charge device during the imaging operations.

46. The engine of claim 37 wherein plural DC voltages are applied to the bias member and the charge device during the imaging operations.

47. The engine of claim 37 wherein the charge device rotates through a plurality of complete revolutions during the imaging operations of the image engine, and wherein the circuitry comprises circuitry configured to apply the electrical energy at a constant voltage to the charge device during the complete revolutions of the charge device during the imaging operations of the image engine.

48. The engine of claim 37 wherein the charge device rotates through a plurality of complete revolutions during the imaging operations of the image engine, and further comprising circuitry configured to apply electrical energy to the bias member, and wherein a voltage of the electrical energy applied to the bias member has a larger absolute value than an absolute value of a voltage of the electrical energy provided to the charge device during the complete revolutions of the charge device during the imaging operations of the image engine.

49. The engine of claim 37 further comprising a development station configured in a dry configuration to apply a dry toner marking agent to a surface of the imaging member to develop the latent images.

50. The engine of claim 37 further comprising a development station configured in a liquid configuration to apply a liquid ink marking agent comprising a liquid to a surface of the imaging member to develop the latent images.

51. The engine of claim 37 wherein the surface of the charge device comprises an electrically conductive outer surface.

52. The engine of claim 37 wherein the portions of the surface of the charge device are individually configured to conduct current externally of the charge device.

53. A photoconductor charging system comprising:

a bias member configured to provide an electrical charge;

a charge device positioned adjacent to the bias member at a first nip location and adjacent to a photoconductor configured to form latent images at a second nip location;

wherein the charge device is configured to rotate during imaging operations, and at a given moment in time, a charged portion of the charge device electrically charges a portion of the photoconductor located at the second nip location and a discharged portion of the charge device located at the first nip location is charged by the electrical charge of the bias member; and supply circuitry configured to provide electrical energy to the charge device independent of the bias member.

54. The system of claim 53 wherein the charge device comprises a charge roller and a plurality of charge carriers of one polarity are transported in a first radial direction relative to a surface of the charge device at the first nip location and a second radial direction substantially opposite to the first radial direction at the second nip location.

55. The system of claim 53 wherein substantially no net DC current flows within an outer layer of the charge device during the imaging operations.

56. The system of claim 53 wherein the charge device is configured to contact the bias member and the photoconductor during the imaging operations.

57. The system of claim 53 wherein the charged portion of the charge device comprises an electrically conductive outer surface of the charge device.

58. An image engine comprising:

means for forming latent images during imaging operations of the image engine;

first means for electrically charging a surface of the means for forming latent images during the imaging operations;

second means for electrically charging a surface of the first means during the imaging operations;

wherein the first means comprises means for moving the surface of the first means adjacent to the means for forming latent images and the second means during the imaging operations of the image engine, and plural charge carriers flow in a first direction relative to a portion of the surface of the first means during the electrical charging of the first means by the second means and plural charge carriers flow in a second direction substantially opposite to the first direction during the electrical charging of the means for forming by the first means; and means for providing electrical energy independent of the second means to the first means for biasing the first means during the electrical charging of the means for forming latent images by the first means.

59. The engine of claim 58 wherein the plural charge carriers flowing in the first and second directions have the same polarity.

60. The engine of claim 58 wherein the first and the second directions comprise substantially opposing radial directions of the first means comprising a charge roller for rotating about an axis.

61. The engine of claim 58 wherein the first means comprises means for receiving the electrical energy and means for transporting the charge carriers, and substantially no net direct current energy flows intermediate the means for receiving the electrical energy and the means for transporting the charge carriers during the imaging operations.

62. The engine of claim 58 wherein the first means comprises means for conducting current external to the first means.

* * * * *

UNITED STATES PATENT AND TRADEMARK OFFICE

CERTIFICATE OF CORRECTION

PATENT NO. : 7,298,993 B2
APPLICATION NO. : 11/030475
DATED : November 20, 2007
INVENTOR(S) : Michael H. Lee et al.

It is certified that error appears in the above-identified patent and that said Letters Patent is hereby corrected as shown below:

In column 7, line 36, delete “b-directional” and insert -- bi-directional --, therefor.

In column 11, line 41, in Claim 16, after “comprising” delete “;” and insert -- : --, therefor.

Signed and Sealed this

Twentieth Day of May, 2008

JON W. DUDAS
*Director of the United States Patent and Trademark Office*